US009114584B2

(12) United States Patent
Coudiere

(10) Patent No.: US 9,114,584 B2
(45) Date of Patent: Aug. 25, 2015

(54) PRESS WITH IMPROVED MAINTENANCE

(75) Inventor: Christophe Coudiere, Montfaucon (FR)

(73) Assignee: AREVA NC, Courbevoie (FR)

( * ) Notice: Subject to any disclaimer, the term of this patent is extended or adjusted under 35 U.S.C. 154(b) by 22 days.

(21) Appl. No.: 14/006,382

(22) PCT Filed: Mar. 21, 2012

(86) PCT No.: PCT/EP2012/054954

§ 371 (c)(1),
(2), (4) Date: Sep. 20, 2013

(87) PCT Pub. No.: WO2012/126930

PCT Pub. Date: Sep. 27, 2012

(65) Prior Publication Data

US 2014/0004220 A1 Jan. 2, 2014

(30) Foreign Application Priority Data

Mar. 23, 2011 (FR) ..... 11 52412

(51) Int. Cl.
*B30B 1/34* (2006.01)
*B30B 15/06* (2006.01)
*B30B 11/02* (2006.01)

(52) U.S. Cl.
CPC ..... *B30B 15/06* (2013.01); *B30B 11/02* (2013.01); *B30B 15/067* (2013.01)

(58) Field of Classification Search
CPC ..... B30B 11/02; B30B 15/026; B30B 15/06; B30B 15/065067; B30B 15/065; B30B 15/067
USPC ..... 425/78, 344–345, 352–355
See application file for complete search history.

(56) References Cited

U.S. PATENT DOCUMENTS

| | | | | |
|---|---|---|---|---|
| 3,890,413 | A | 6/1975 | Peterson | |
| 4,323,003 | A | 4/1982 | Clippard, III | |
| 6,276,247 | B1 * | 8/2001 | Helda | 83/684 |
| 6,334,381 | B1 * | 1/2002 | Chatham | 83/588 |

(Continued)

FOREIGN PATENT DOCUMENTS

| | | | |
|---|---|---|---|
| CN | 101758637 | B | 8/2014 |
| FR | 1206366 | A | 2/1960 |
| GB | 2 047 142 | A | 11/1980 |

OTHER PUBLICATIONS

International Search Report for PCT/EP2012/054954 dated Jul. 5, 2012.

(Continued)

*Primary Examiner* — Joseph S Del Sole
*Assistant Examiner* — Thukhanh T Nguyen
(74) *Attorney, Agent, or Firm* — Pearne & Gordon LLP

(57) ABSTRACT

Guide and retaining assembly for a press compensator comprising:

a guide bushing (32) for the compensator (20) in its bore, said guide bushing being designed to be fitted around the compensator, a retaining nut (38) that that is configured to be screwed into the bore, the guide bushing (32) being located between a shoulder on the compensator and the retaining nut (38), and means (44) axially fixing the guide bushing (32) and the retaining nut (38) while maintaining an axial and transverse clearance between the guide bushing (32) and the retaining nut (38), said means (44) being such that the guide bushing (32) is free to rotate relative to the retaining nut (38).

11 Claims, 5 Drawing Sheets

(56) References Cited

U.S. PATENT DOCUMENTS

| | | | | |
|---|---|---|---|---|
| 7,168,356 | B2 * | 1/2007 | Rosene et al. | 83/686 |
| 7,658,134 | B2 * | 2/2010 | Morgan | 83/530 |
| 8,714,065 | B2 * | 5/2014 | Takahashi et al. | 83/686 |
| 2010/0083726 | A1 | 4/2010 | Cotter | |

OTHER PUBLICATIONS

Office Action cited in corresponding Chinese Patent Application No. 201280014732.5 dated Oct. 8, 2014.

* cited by examiner

PRESS WITH IMPROVED MAINTENANCE

TECHNICAL FIELD AND PRIOR ART

This invention relates to a press with improved maintenance, for example a press intended for the fabrication of nuclear fuel pellets.

A press for fabrication of nuclear fuel pellets comprises a table in which moulding dies are made for pressing nuclear fuel powder between two punches, a lower punch and an upper punch. The upper punch moves inside the die while pressing takes place, while the lower punch remains motionless.

For example, the powder is formed of a mix of plutonium oxide and uranium oxide.

The table comprises a plurality of dies simultaneously pressed by a plurality of punches. Each upper punch is supported by a compensator, itself fitted in a common support that is moved relative to the table by means of an actuator. The support is called the "compensator casing".

A compensator forms a piston, free to move while remaining sealed inside a bore formed in the compensator casing. Oil under pressure is injected between the bottom of the piston and the bottom of the bore so as to push the piston carrying the punch towards the outside of the compensator casing. The bores are connected to each other and the compensators balance the oil pressure on the different punches.

Each compensator comprises a large diameter part on which oil pressure is applied, and a small diameter part one free end of which supports the punch.

The large diameter part comprises seals around its periphery. The compensator is guided in the bore by a bushing surrounding the small diameter part. The bushing itself is held inside the bore by a nut screwed into the compensator bore. The bushing also comprises seals around its outside periphery and on its inside periphery.

A reliable tightness of the compensator assembly is required to prevent pollution of the dies and the nuclear fuel powder. Remember that the press is located inside a glove box, for safety reasons; consequently, any work on the press is long and tedious. Furthermore, the pellets have to be scrapped if the powder is polluted. The tightness's are then monitored regularly which requires disassembly of the compensators. This is done by unscrewing the retaining nut and the guide bushing is then withdrawn and finally the compensator is extracted from its bore. The guide bushing sometimes remains trapped in the bore, in which case a tension force has to be applied on the bushing which can damage the bushing and the inside of the bore. Furthermore, this zone is difficult to access and work always has to be done through a glove port. This high force is applied at arm's length. Seals can also be damaged when the bushing is reassembled.

PRESENTATION OF THE INVENTION

Consequently, one purpose of this invention is to disclose a compensator assembly for a press with improved reliability and simpler maintenance.

This purpose is achieved by a guide bushing and a retaining nut assembly fixed to each other axially, while maintaining an axial clearance and a radial clearance between the guide bushing and the retaining nut to enable self-centring of the bushing in the bore and around the compensator, during assembly, to prevent deterioration to the seals. The bushing is also free to rotate relative to the nut. Thus, the bushing does not turn on itself when the nut is tightened or loosened, which reduces the risks of damage to the seals that it carries.

During disassembly, the guide bushing is removed with the retaining nut, therefore its removal is simplified.

The subject-matter of this invention is then a guide and retaining assembly for a press compensator comprising:

- a guide bushing for the compensator in its bore, said guide bushing being designed to be fitted around the compensator,
- a retaining nut that is configured to be screwed into the bore, the guide bushing being located between a shoulder on the compensator and the retaining nut, and
- means axially fixing the guide bushing and the retaining nut while maintaining an axial and transverse clearance between the guide bushing and the retaining nut, said means being such that the guide bushing is free to rotate relative to the retaining nut.

Advantageously, the guide bushing is surrounded by the retaining nut over part of its length, and the fixing means comprise at least two radial pins housed in radial drillings formed in the retaining nut and one radially inner end of which opens up into an annular groove formed in the outer periphery of the guide bushing, a radial clearance being provided between the radially inner end of the radial pins and a radial bottom of the groove and axial clearance being provided between the side edges of the radially inner end of the radial pins and the lateral edges of the groove.

Preferably, the radial pins are held in position in radial housings by means of pressure screws. The pressure screws may be fixed in place axially for example by striking with a punch or by thread lock. The radially inner end of the pins advantageously has a reduced diameter. The radial pins are preferably arranged in a set of three at 120° from each other.

The guide bushing may comprise a compensator guide segment at its inner periphery.

In one example embodiment, the retaining nut comprises marks on a transverse face opposite the face in contact with the guide bushing, that are configured to cooperate with marks on a tool to apply a tightening or loosening force on the retaining nut.

Another subject-matter of this invention is also a press comprising:

- a table provided with at least two moulding dies,
- punches with a longitudinal axis that are configured to penetrate into the dies,
- a punch support that can be displaced by an actuator to bring the punches towards the moulding dies in a longitudinal direction,
- compensators associated with each punch, each compensator having a longitudinal axis and being installed sealed in a bore in the support, and comprising a first longitudinal end on which hydraulic fluid pressure is intended to be applied and a second longitudinal end carrying the punch, said bores being in fluid communication with each other, and
- compensator guide and retaining assemblies according to this invention fitted in each of the bores.

For example, the press forms a nuclear fuel pellet fabrication press.

An assembly and disassembly tool for the press compensator guide and retaining assembly according to this invention for tightening and loosening compensator retaining nuts, may have a longitudinal axis and comprise a central cavity open at a first end inside which the second end of the compensator is intended to be fitted, said open end being bounded by an annular surface provided with recessed or projecting marks corresponding to projecting or recessed marks respectively on the nut housings, and at a second end, means for applying a rotation force on the tool around its longitudinal axis.

The tool may be provided with projecting marks and the nut may be provided with recessed marks.

The means for applying a rotation force to the tool consist for example of a mark for assembly and for fixing the angular position of a lever on the tool, for example a recessed or projecting polygonal mark.

Preferably, the side wall of the central housing is perforated.

The depth of the housing may be made to correspond approximately either to the length of the part of the compensator projecting from the nut, or the length of the assembly formed by the part of the compensator projecting from the nut and the punch.

BRIEF DESCRIPTION OF THE DRAWINGS

This invention will be better understood after reading the following description and the appended drawings in which.

DETAILED PRESENTATION OF PARTICULAR EMBODIMENTS

Figure 1:
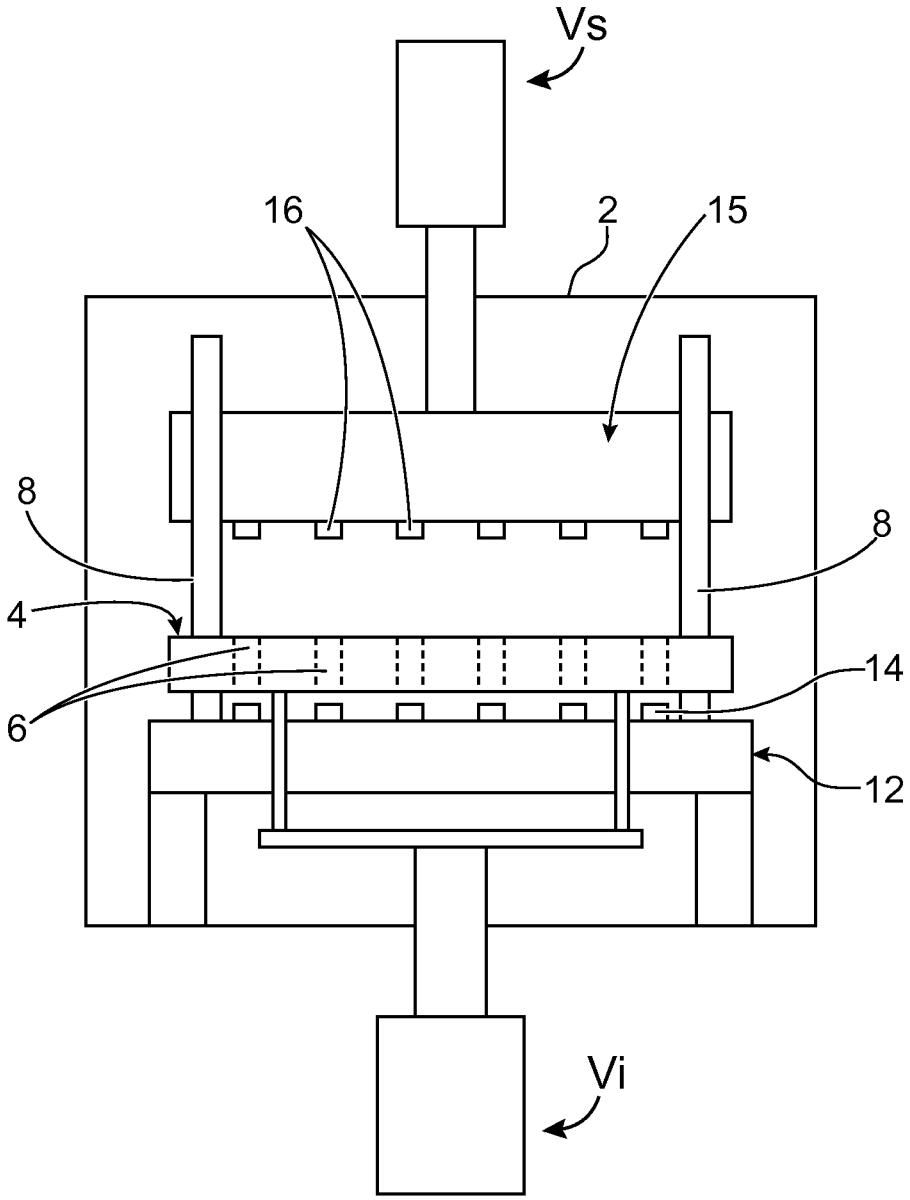
FIG. 1 is a diagrammatic view of a nuclear fuel pellet fabrication press to which this invention could be applicable.

FIG. 1 shows a very diagrammatic view of a press for the fabrication of nuclear fuel pellets.

This invention is applicable to any type of hydraulic press and is not limited to the nuclear field. It is particularly advantageous in fields in which cleanliness is an important criterion, but also in all fields involving presses, because of its simplified maintenance.

The press in FIG. 1 is housed in a confined containment 2, of the glove box type. It comprises a table 4 supporting the moulding dies 6 mounted free to move along guide columns 8, a lower actuator Vi to move the table 4, a fixed support 12 for lower punches 14 and a mobile support 15 for upper punches 16 and can be moved by an upper actuator Vs. The support 15 forms the compensator casing and carries the compensators (not shown) and the upper punches 16. In the example shown, the actuators pass through the walls of the containment 2 in a sealed manner.

Figure 2:
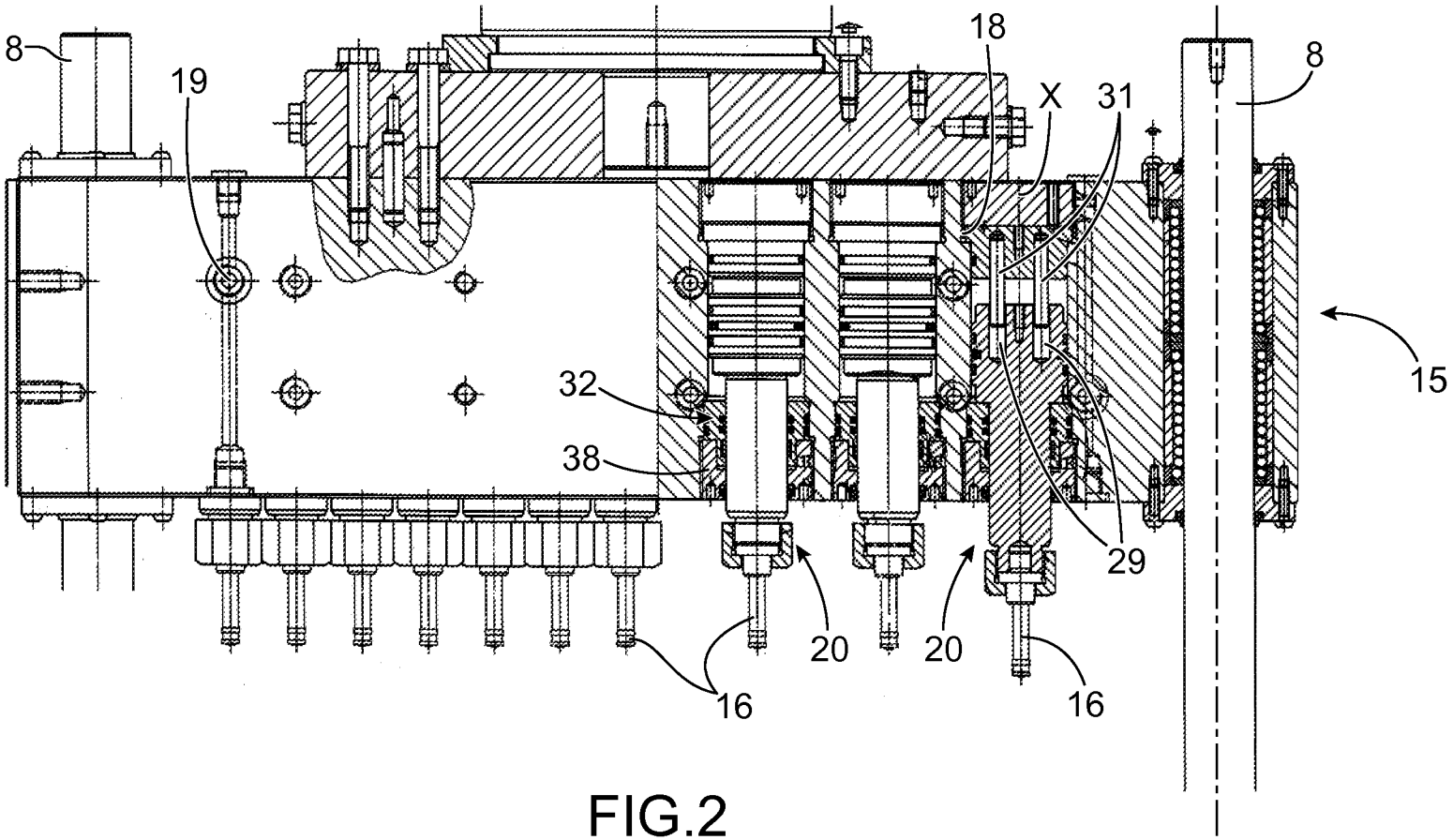
FIG. 2 is a partial sectional view of a compensator casing provided with upper punches, adapted to the press in FIG. 1.
Figure 3:
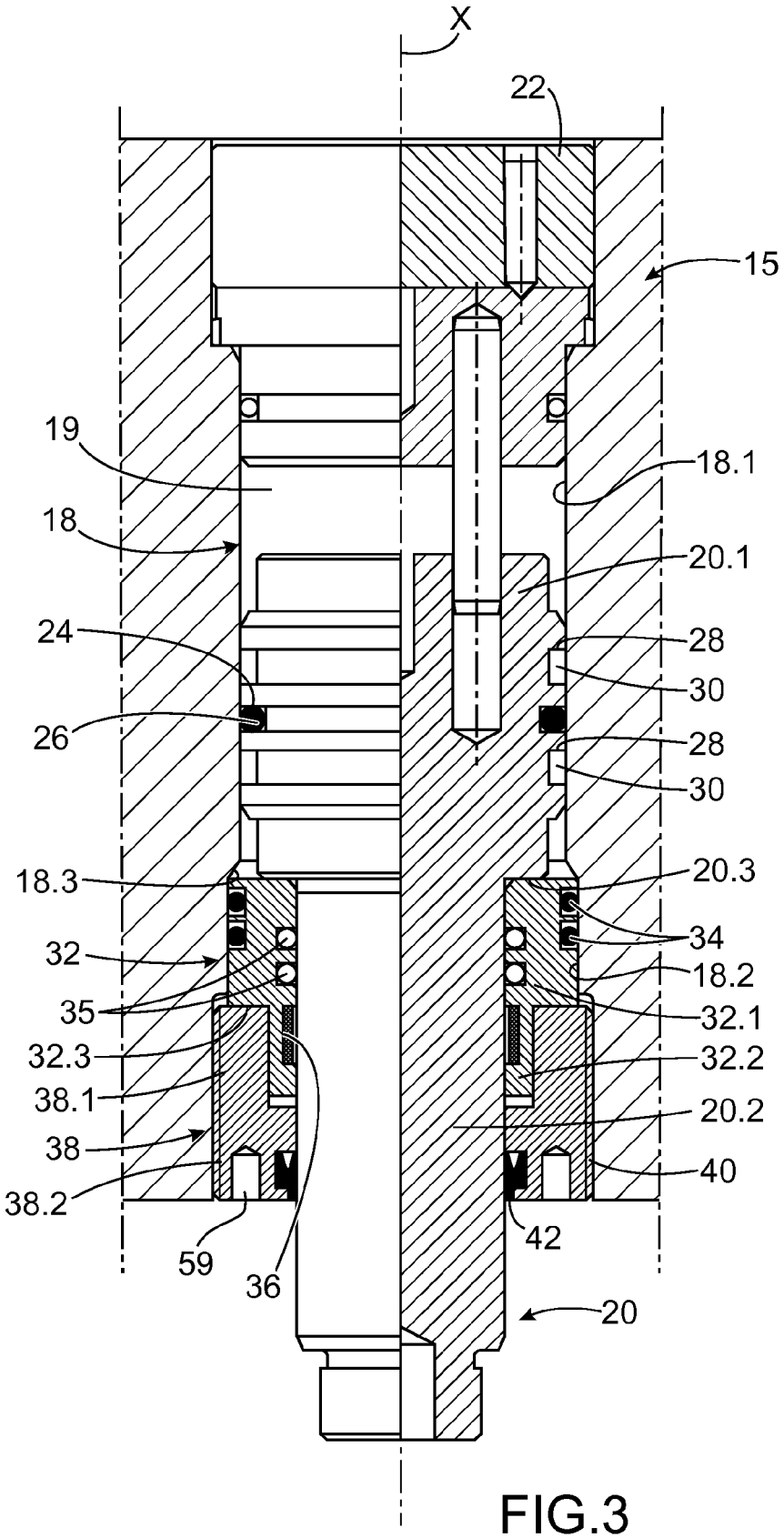
FIG. 3 is an enlarged view of a detail in FIG. 2.

FIG. 2 shows a detailed view of the compensator casing 15 and FIG. 3 shows a compensator alone fitted in its bore.

The compensator casing 15 is formed by a plate inside which bores 18 are machined, with longitudinal axis X, each of which holds a compensator 20. In the example shown, the bores 18 are through holes and are closed off by a plug 22 at one end, opposite the end from which the compensator exits.

Each bore 18 comprises a first portion with a smaller diameter 18.1 and a second portion with a larger diameter 18.2 connected to the smaller diameter of portion 18.1 through an annular contact surface 18.3. The compensator 20 comprises a first part with a larger diameter 20.1 and a second part with a smaller diameter 20.2 connected to the larger diameter part through a shoulder 20.3. The larger diameter part 20.1 fits into the portion with the smaller diameter 18.1 of the bore 18.

For example, the part with the larger diameter 20.1 of the compensator 20 comprises a groove 24 into which a seal 26 fits and two grooves 28 located on each side of the groove 24 into which the guide rings 30 fit. Advantageously, the bottom of the larger diameter part 20.1 of the compensator comprises two bores 29 each of which holds two anti-rotation pins 31 fixed in the bottom of the bore 18.

The bottom of each bore and the bottom of the compensator that fits into it delimit a chamber 19 that is configured to be filled with oil under pressure. The chambers 19 of all bores are in fluid communication with each other to enable oil circulation between the chambers 19 and to balance the pressures on punches during the pressing step.

Branch connections 19 (FIG. 2) made on the front face of the compensator casing are used to fill the bores.

A guide bushing 32 is installed in the larger diameter portion 18.2 of the bore 18 and is stopped in contact with the annular contact surface 18.3. The bushing 32 surrounds the smaller diameter part 20.2 of the compensator 20. The bushing comprises a large outside diameter part 32.1 and a small outside diameter part 32.2 connected through a shoulder 32.3.

In the example shown, the guide bushing 32 comprises two seals 34 on its outer periphery and two axially offset sealing means 35 and a compensator guide segment 36, at its inner periphery. The guide segment is assembled in the small outside diameter part 32.2. Advantageously, each of the sealing means 35 comprises an O-ring mounted radially at the bottom of the groove and a sealing ring at the outlet from the groove that applies friction on the compensator. The ring is then forced into contact with the compensator by the O-ring and by oil under pressure.

A retaining nut 38 is installed in the larger diameter part 18.2 of the bore 18 and bears in contact with the shoulder 32.3 of the guide bushing 32.

The retaining nut 38 comprises a part 38.1 with large inside diameter and a part 38.2 with a small inside diameter. The retaining nut 38 is assembled around the bushing such that its part 38.1 with a large inside diameter surrounds the part 32.2 with a small outside diameter of the guide bushing 32.

The retaining nut 38 comprises a thread 40 on its outer periphery cooperating with a thread on the larger diameter portion 18.2. The retaining nut is fitted with a seal 42 on its inner periphery, for example of the lip seal type, applying friction on the part 20.2 of the compensator with a small diameter.

A clearance is provided between the inside diameter of the large diameter part 38.1 of the nut and the outside diameter of the small diameter part of the bushing 32, such that the bushing is not force fitted into the nut.

Figure 4A:
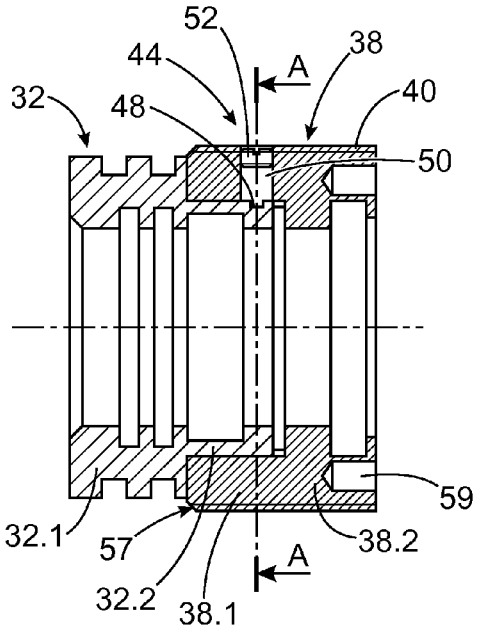
FIG. 4A is a longitudinal sectional view of an assembly composed of the assembly bushing and guide nut shown alone, along a different section plane from that in FIG. 3.

FIG. 4A shows a sectional view of the guide bushing 32 and retaining nut 38 assembly, shown alone in a different sectional plane from that in FIG. 3.

According to this invention, the bushing 32 and the nut are axially and radially fixed to each other, while leaving an axial and radial clearance between the parts. Fixing means 44 with clearance are then provided between the bushing 32 and the nut 38.

Figure 4C:
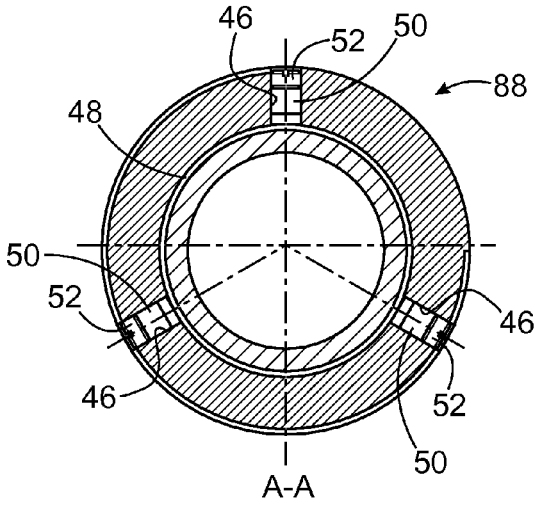
FIG. 4C is a cross-sectional view along plane A-A in FIG. 4A, FIGS. 5A and 5B are longitudinal sectional views of example embodiments of tools for the disassembly of the guide bushing and retaining nut assembly.
Figure 4B:
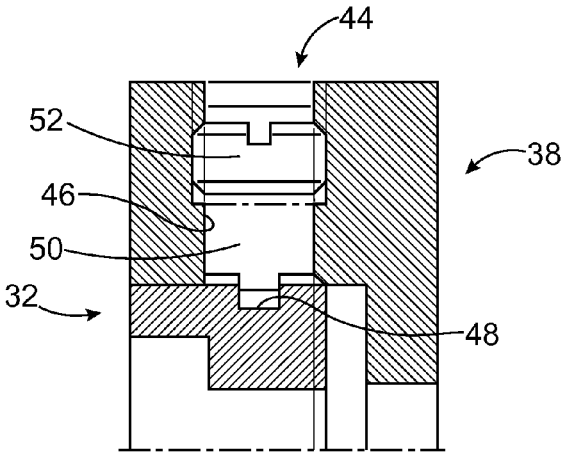
FIG. 4B is a detailed view of FIG. 4A.

In the example shown in FIGS. 4B and 4C and advantageously, the fixing means 44 comprise three radial drillings 46 arranged at 120° from each other formed in the small inside diameter part of the nut, and opening up in a groove 48 formed in the periphery of the small outside diameter part 32.2 of the bushing 32, and pins 50 that fit in the housings 46 and penetrate into the groove 48. The outside dimensions of the pins and the dimensions of the groove 48 are chosen to assure a radial clearance and an axial clearance. The pins 50 are installed free to slide in the housings 46.

The fixing means may comprise two pins, however the use of three pins reduces risks of the nut being skewed relative to the bushing.

The groove 48 makes it unnecessary to orient the angle of the nut relative to the bushing. Furthermore, the bushing is not fixed in rotation with the nut. Thus, when tightening and loosening the nut, the bushing 32 does not turn with the nut, so that no force is applied to the seals.

In the example shown and advantageously, the transverse position of the pins and therefore the radial clearance are adjusted by pressure screws 52 screwed into the radial drillings 46 after the pins have been inserted.

The use of pressure screws provides an additional part on which tolerances and therefore clearance can be added. This part makes it possible to improve the axial clearance.

Advantageously, pressure screws 52 are prevented from rotation to give a fixed position of the pins over time, for example by thread lock or by striking with a punch at the thread. This permanent attachment can very easily fix the clearances permanently. This is made possible because the bushing and the nut never need to be separated during the life of the press.

Advantageously, the end of the pins 50 penetrating into the annular groove 48 has a reduced diameter end section which can limit the size of the annular groove 48 so that weak points are not induced in the bushing 32. This end with a reduced diameter cross section provides a non-restrictive guide for the seals of the bushing 32 during placement of the bushing 32 and nut 38 assembly in the bore of the compensator casing. When in the blocked position, the tightening force is resisted by the contact surfaces of parts 32 and 38 at the contact surface 57 in FIG. 4A.

For example, there is an axial clearance between the bushing 38 and the nut 37 of between 0.045 mm and 0.355 mm. When the pressure screws 52 are put into place, the tightness is adjusted to maintain a radial clearance of between 0.05 mm and 0.139 mm.

Thus, the bushing 32 is removed when the nut 38 is loosened.

These fixing means also have the advantage that they do not disturb the compensator seal.

Figure 5A:
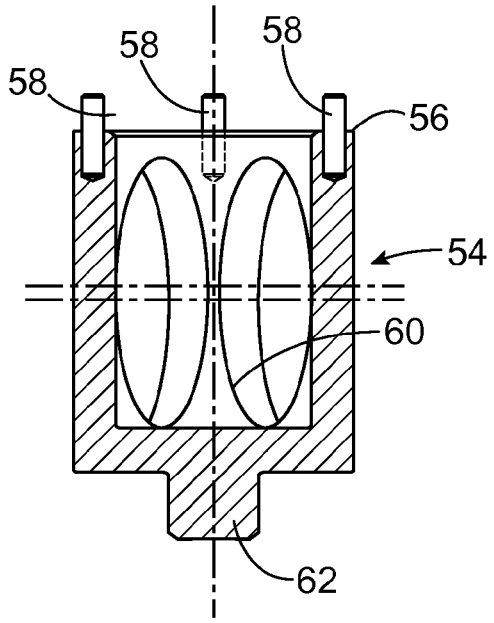
Figure 5B:
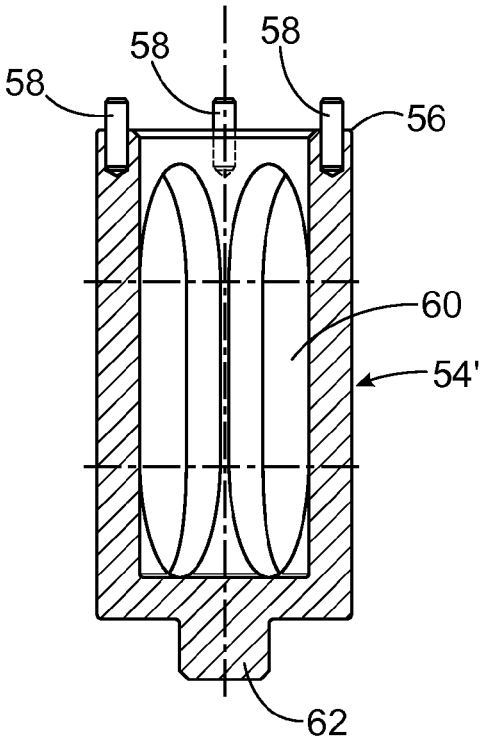

FIGS. 5A and 5B show specially adapted tools for tightening/loosening the retaining nut 38.

In FIG. 5A, the tool 54 is adapted to tightening/loosening the retaining nut 38 when the punch is not mounted on the compensator 20. The tool 54 comprises means of entraining the nut in rotation in the tightening or loosening direction.

In the example shown, the tool 54 comprises an annular face 56 at a first longitudinal end provided with three projecting pins 58 extending longitudinally. The pins 58 are designed to penetrate into three corresponding housings 59 formed in one face of the retaining nut 38 oriented towards the outside of the bore 18. For example, the pins 58 are formed from studs installed in bores formed in the transverse face 56. The tool comprises at least two pins and preferably at least three.

The tool 54 also comprises a central cavity 60 bounded by the annular face 56; the cavity 60 is configured to hold the projecting end of the compensator 20.

The tool 54 comprises a mark 62 at one longitudinal end which is opposite to the end carrying the pins, on which a tool is intended to be fitted to form a lever capable of applying a torque on the tool around the longitudinal axis. In the example shown, the mark 62 is projecting and is hexagonal in shape and the tool is a ratchet handle. As a variant, the mark may be recessed and have a hexagonal or square section, etc., the lever is then fixed at a particular angle on the tool 54 and applying a torque on the lever will cause rotation of the tool.

Advantageously, the side wall of the central cavity 60 is perforated to reduce the mass of the tool 54. This tool is held at arm's length during assembly and disassembly operations.

As a variant, it can be imagined that the retaining nut comprises projecting pins and that the tool comprises corresponding recessed marks.

In FIG. 5B, the tool 54' is similar to the tool 54; however, it is adapted to tightening/loosening the retaining nut 38 when the punch is mounted on the compensator 20. To achieve this, the central cavity 60 is deeper so as to house the compensator and the punch.

We will now describe the disassembly and assembly of a compensator using the bushing and nut assembly.

The compensator seals are verified during press maintenance operations. We will consider the case in which the upper punches have been removed from the compensators.

The tool 54 is mounted around the punch and is oriented such that the pins 58 are facing the housings in the nut. The tool is then brought axially towards the nut and pins penetrate into the housings. A torque is applied on the tool 54 in the direction to loosen the nut 38. The nut 38 turns on itself and is unscrewed. Almost simultaneously, the bushing 32 is entrained in rotation and axially by the nut 38, displacement of the bushing 32 takes place with a slight delay due to the axial and radial clearances.

The nut 38 and the bushing 32 are removed. The compensator is then extracted from the bore 18, by applying a tension force on the compensator.

The seals are verified and replaced if necessary.

During reassembly, the compensator 20 is inserted into the bore 18, advantageously using a sleeve (not shown). The compensator is oriented such that the anti-rotation pin fitted in the bottom of the bore penetrates into the compensator bore.

The bushing 32 and nut 38 assembly is then inserted into the bore 18 and mounted around the compensator. The bushing 32 is assembled with special care to avoid damaging the seals. The nut 38 is then screwed into the bore, which forces the bushing 32 in the axial direction until it stops in contact with the annular contact surface of the bore. Due to the radial clearance and the axial clearance, the bushing 32 can be positioned on the compensator 20 and in the bore 18 without damaging the seals.

This invention simplifies maintenance of presses and more particularly maintenance of compensators, by simplifying disassembly of the guide bushing and protection of the seals during assembly of the bushing.

What is claimed is:

1. A press compensator assembly including a guide and retaining assembly for a press compensator comprising:

a compensator casing comprising a bore in which the compensator is fitted;

a guide bushing for the compensator, wherein the guide bushing is arranged in the bore, said guide bushing being designed to be fitted around the compensator, a retaining nut that is configured to be threaded into the bore, the guide bushing being located between a shoulder on the compensator and the retaining nut, and means axially fixing the guide bushing and the retaining nut while maintaining an axial and transverse clearance between the guide bushing and the retaining nut, said means being such that the guide bushing remains free to rotate relative to the retaining nut.

2. The assembly according to claim 1, in which the guide bushing is surrounded by the retaining nut over part of its length, and the fixing means comprise at least two radial pins housed in radial drillings formed in the retaining nut and one radially inner end of which opens up into an annular groove formed in an outer periphery of the guide bushing, a radial clearance being provided between the radially inner end of the radial pins and a radial bottom of the groove and an axial clearance being provided between the side edges of the radially inner end of the radial pins and the lateral edges of the groove.

3. The assembly according to claim 2, wherein the radial pins are held in position in radial housings by pressure screws.

4. The assembly according to claim 3, wherein the pressure screws are fixed in place axially.

5. The assembly according to claim 3, wherein the pressure screws are fixed in place axially by striking with a punch or by thread lock.

6. The assembly according to claim 2, wherein the radially inner end of the pins has a reduced diameter.

7. The assembly according to claim 2, wherein the radial pins are arranged in a set of three at 120° from each other.

8. The assembly according to claim 1, wherein the guide bushing comprises a compensator guide segment at its inner periphery.

9. The assembly according to claim 1, wherein the retaining nut comprises marks on a transverse face opposite the face in contact with the guide bushing, the marks being configured to cooperate with marks on a tool to apply a tightening or loosening force on the retaining nut.

10. A press comprising:

a table provided with at least two moulding dies, punches with a longitudinal axis that is configured to penetrate into the dies, a punch support that can be displaced by an actuator to bring the punches towards the moulding dies in a longitudinal direction, compensators associated with each punch, each compensator having a longitudinal axis and being installed sealed in a bore in the support, and comprising a first longitudinal end on which hydraulic fluid pressure is intended to be applied and a second longitudinal end carrying the punch, said bores being in fluid communication with each other, and compensator guide and retaining assemblies fitted in each of the bores, the compensator guide and retaining assemblies comprising a guide bushing for the compensator, wherein the guide bushing is arranged in the bore, said guide bushing being designed to be fitted around the compensator, a retaining nut that is configured to be threaded into the bore, the guide bushing being located between a shoulder on the compensator and the retaining nut, and means axially fixing the guide bushing and the retaining nut while maintaining an axial and transverse clearance between the guide bushing and the retaining nut, said means being such that the guide bushing remains free to rotate relative to the retaining nut.

11. The press according to claim 10, forming a nuclear fuel pellet fabrication press.

* * * * *

UNITED STATES PATENT AND TRADEMARK OFFICE

CERTIFICATE OF CORRECTION

PATENT NO. : 9,114,584 B2
APPLICATION NO. : 14/006382
DATED : August 25, 2015
INVENTOR(S) : Christophe Coudiere It is certified that error appears in the above-identified patent and that said Letters Patent is hereby corrected as shown below:

In the specification,

Column 4, line 7, please insert --20-- between "compensator" and "comprises"

Column 4, line 39, please insert --32-- between "bushing" and "such"

Signed and Sealed this
Fifth Day of July, 2016

Michelle K. Lee

Michelle K. Lee
*Director of the United States Patent and Trademark Office*